US005642649A

United States Patent [19]

Hsieh

[11] Patent Number: 5,642,649

[45] Date of Patent: Jul. 1, 1997

[54] SCREWDRIVER WITH WRENCH ENGAGING COLLAR

[76] Inventor: Chih-Ching Hsieh, No. 64, Lane 107, Liang Tsun Rd., Fong Yuan City, Taichung Hsien, Taiwan

[21] Appl. No.: 728,528

[22] Filed: Oct. 9, 1996

[51] Int. Cl.[6] ..... B25B 13/00

[52] U.S. Cl. ..... 81/58.1

[58] Field of Search ..... 81/58, 58.1, 436, 81/177.2

[56] References Cited

U.S. PATENT DOCUMENTS 1,014,417 1/1912 Seelig ..... 81/436

2,513,509 7/1950 Morts ..... 81/436

4,541,314 9/1985 Korkowski ..... 81/58.1

*Primary Examiner*—James G. Smith

*Assistant Examiner*—Joni B. Danganan

*Attorney, Agent, or Firm*—Varndell Legal Group

[57] ABSTRACT

A screwdriver including a blade, and a handle at one end of the blade, the blade having a collar raised around the periphery and connected to the handle, the collar having a substantially oval profile through which the blade can be gripped and turned with any one of different sizes of open end wrenches with less effort.

1 Claim, 4 Drawing Sheets

SCREWDRIVER WITH WRENCH ENGAGING COLLAR

BACKGROUND AND SUMMARY OF THE INVENTION

The present invention relates to screwdrivers, and relates more particularly to such a screwdriver which has a collar raised around the blade and connected to the handle, which collar has a substantially oval profile through which the screwdriver can be gripped and turned with any one of different sizes of open end wrenches with less effortt.

Screws are commonly used in fastening parts of a device together. When turning a screw, a screwdriver shall be used. However, if an installed screw is covered with rust, it can not be conveniently turned with a screwdriver, and the tip of the blade of the screwdriver may be damaged if turned with force. There is known a screwdriver which as a square collar raised around the periphery of the blade and connected to the handle (see FIGS. 1 and 1A). Through the square collar, the screwdriver can be conveniently turned with an open end wrench with less effort. As an alternate form of the prior art screwdriver, the collar may be made having a hexagonal cross section (see FIG. 2). However, this design of collar fits only one particular size of open end wrench, that is only one particular size of open end wrench can be used for gripping and turning the screwdriver with less effort.

The present invention has been accomplished under the circumstances in view. It is the major object of the present invention to provide a screwdriver which can be conveniently turned with any one of different sizes of open end wrenches. To achieve this object, the collar is made having a substantially oval profile to fit different sizes of open end wrenches.

DETAILED DESCRIPTION OF THE PREFERRED EMBODIMENT

Figures 1, 1A, 2:
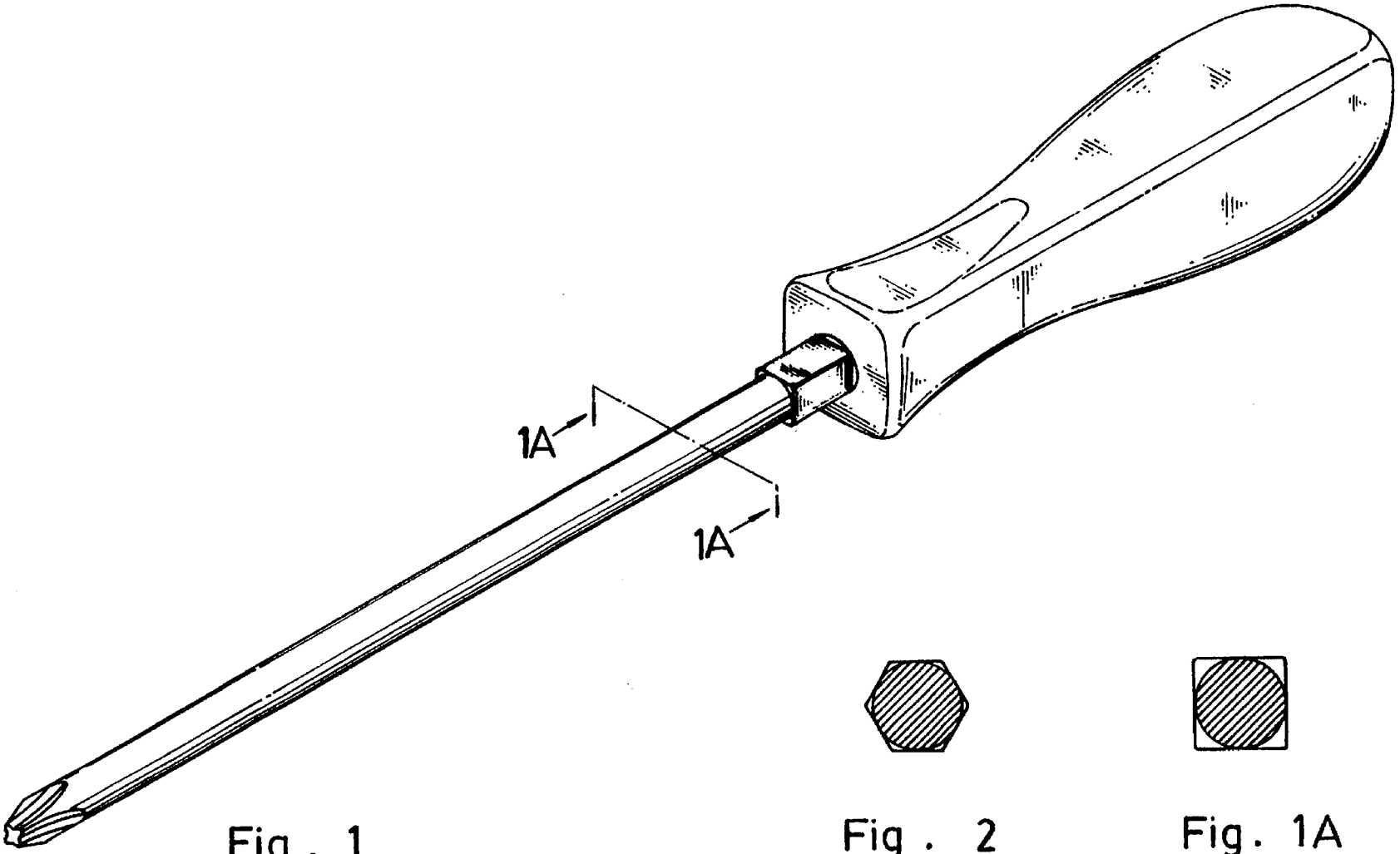
Fig. 1 PRIOR ART
Fig. 2 PRIOR ART
Fig. 1A PRIOR ART
FIG. 1 is an elevational view of a screwdriver according to the prior art.
FIG. 1A is a cross-sectional view taken along line 1A—1A of FIG. 1.
FIG. 2 is a cross-sectional view of the blade of another structure of screwdriver according to the prior art.
Figures 3, 3A:
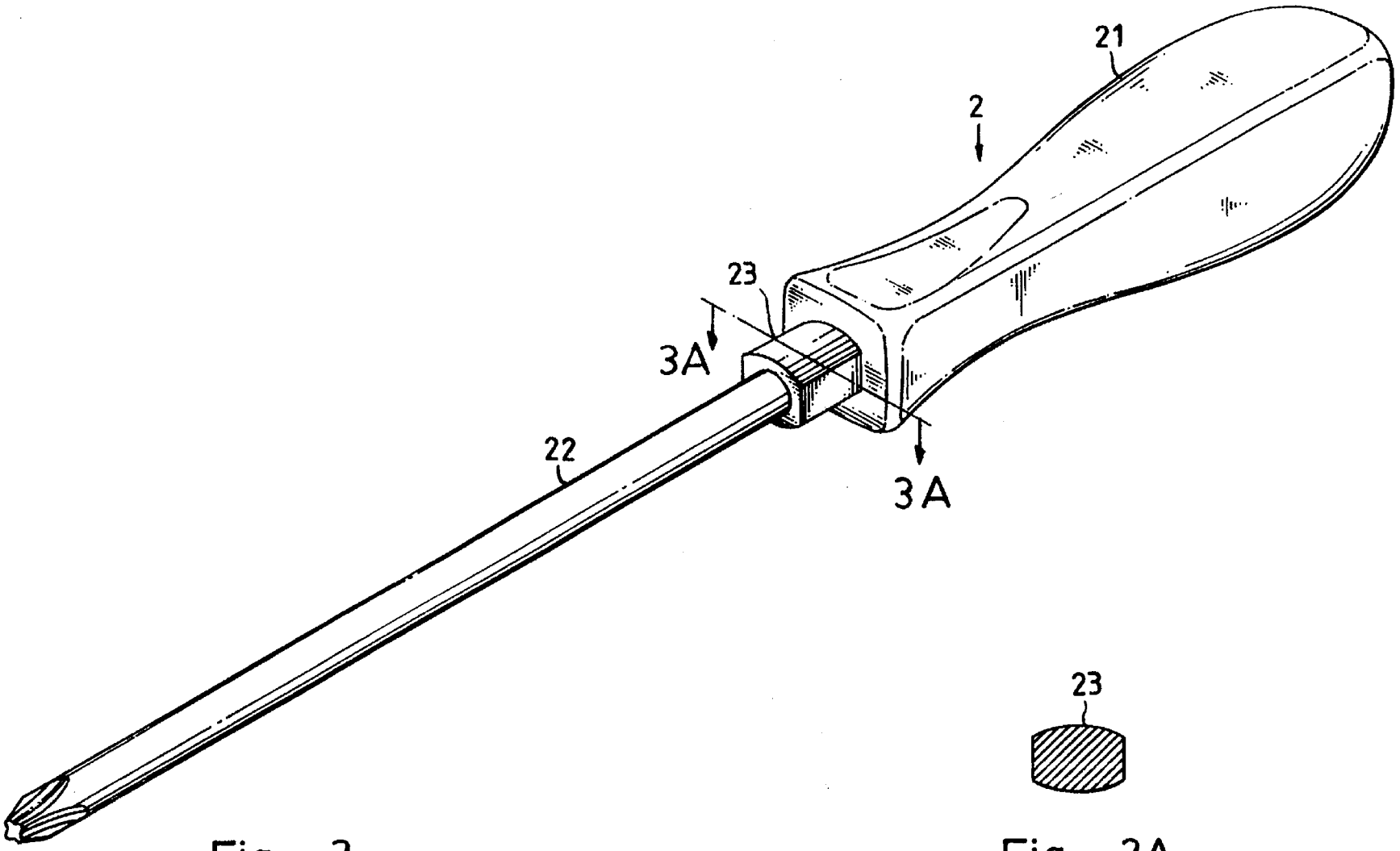
FIG. 3 is an elevational view of a screwdriver according to the present invention.
FIG. 3A is a cross sectional view taken along line 3A—3A of FIG. 3.
Figure 4:
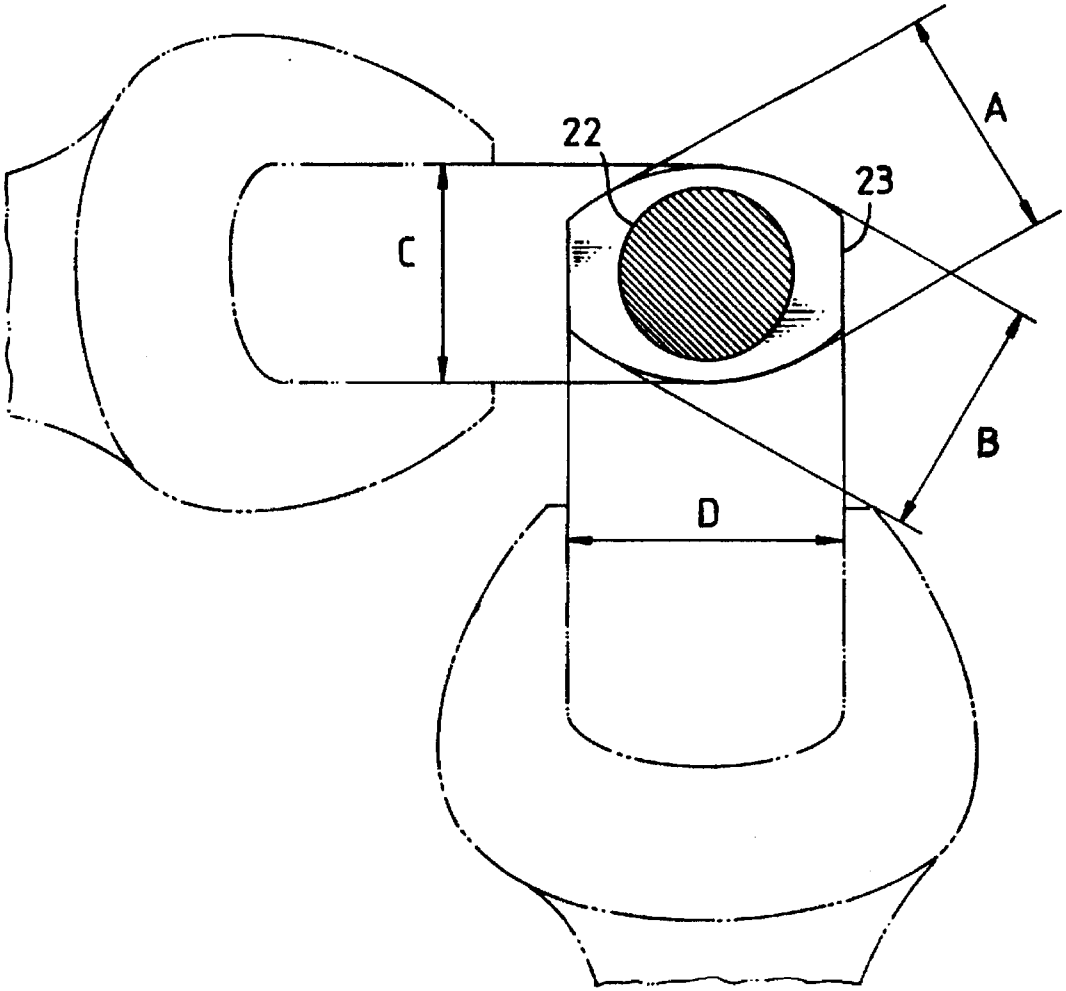
FIG. 4 is a schematic drawing showing applicability of different sizes of open end wrenches to the collar of the blade of the screwdriver according to the present invention.

Referring to FIGS. 3 and 3A, a screwdriver 2 in accordance with the present invention is generally comprised of a blade 22, and a handle 21 at one end of the blade 22. The blade 22 has a collar 23 raised around the periphery and closely attached to the handle 21 on the outside. The collar 23 has a rear side connected to the handle 21, a front side disposed in parallel to the rear side, a top side curved outwards, a bottom side curved outwards opposite to the top side, and two opposite straight lateral sides bilaterally connected in parallel between the top side and the bottom side. Because the collar 23 has a substantially oval profile, the distances A, B, C, D of the pairs of parallel tangent lines that touch different sides of the collar 23 are different. Therefore, different sizes of open end wrenches can be alternatively used for gripping the collar 23 and turning the blade 22.

Figure 5:
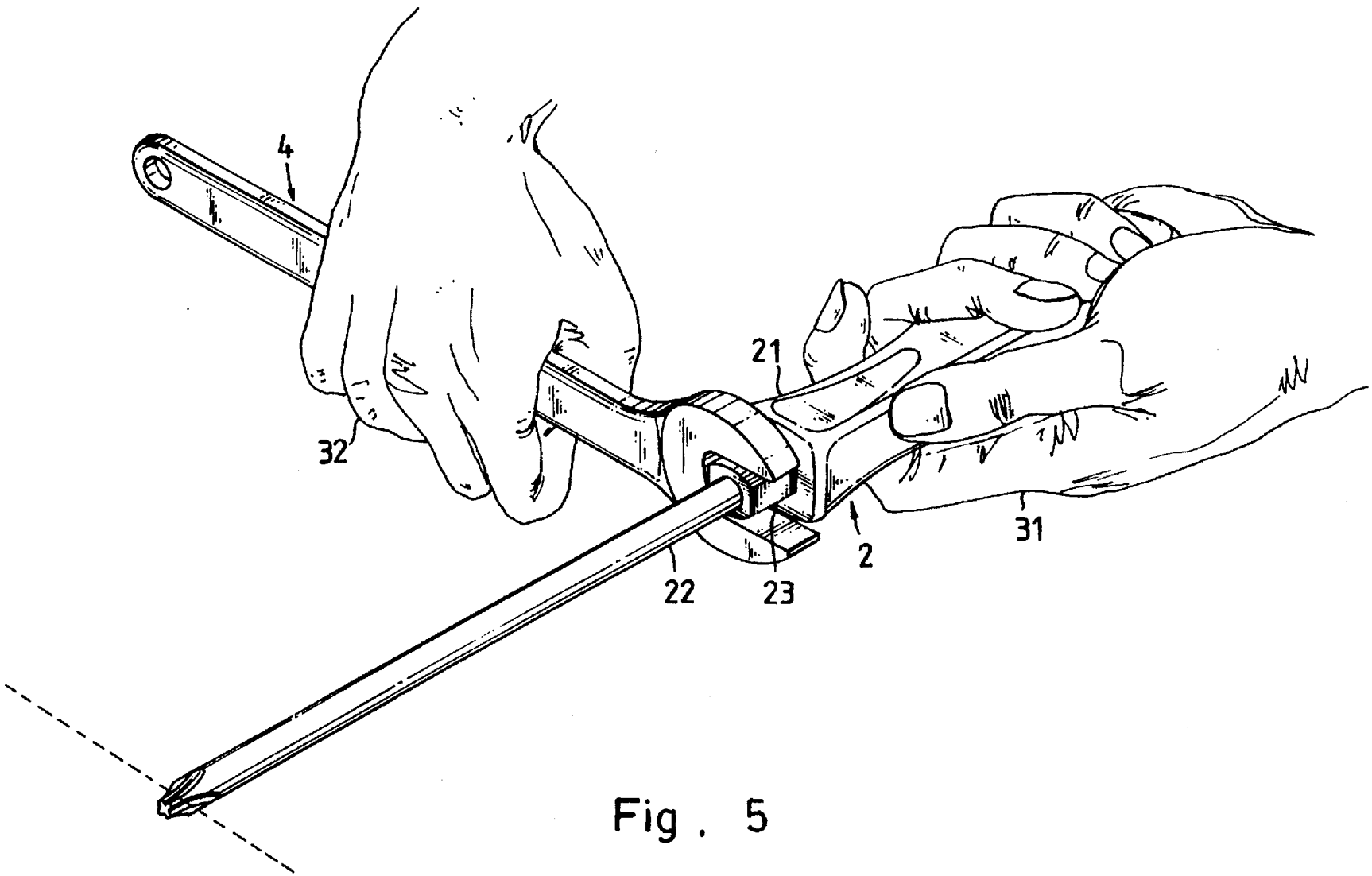
FIG. 5 is an applied view of the present invention, showing the handle of the screwdriver held in one end, and an open end wrench held in the other and grasped at the collar of the blade.

FIG. 5 shows the handle 21 of the screwdriver 2 held in one hand 31, an open end wrench 4 held in the other hand 32 and attached to the collar 23 of the blade 22. By means of the long arm of force of the open end wrench 4, the screwdriver 2 can be turned with less effort to remove for example a rusted screw from an object.

I claim:

1. A screwdriver comprising a blade, and a handle at one end of said blade, said blade having a collar raised around the peripery and connected to said handle through which said blade can be gripped and turned with an open end wrench, wherein said collar has a rear side connected to said handle, a front side disposed in parallel to said rear side, a top side curved outwards, a bottom side curved outwards opposite to said top side, and two opposite straight lateral sides bilaterally connected in parallel between said top side and said bottom side.

* * * * *